US005529246A

United States Patent [19]

Saito et al.

[11] Patent Number: 5,529,246

[45] Date of Patent: Jun. 25, 1996

[54] DISK-TYPE ELECTROSTATIC POWDER COATING METHOD AND AN APPARATUS THEREFOR

[75] Inventors: Eiji Saito, Kanagawa-ken; Takao Murakami, Tokyo, both of Japan

[73] Assignee: Ransburg Industrial Finishing K.K., Tokyo, Japan

[21] Appl. No.: 184,169

[22] Filed: Jan. 21, 1994

[30] Foreign Application Priority Data

Jan. 20, 1993 [JP] Japan ..... 5-007443

[51] Int. Cl.[6] ..... B05B 5/04

[52] U.S. Cl. ..... 239/702; 239/3; 239/223; 239/700

[58] Field of Search ..... 239/700, 701, 239/702, 703, 223, 224, 3

[56] References Cited

U.S. PATENT DOCUMENTS

| | | | |
|---|---|---|---|
| 1,870,099 | 8/1932 | Croan | 239/223 |
| 2,728,606 | 12/1955 | Smart et al. | 239/224 |
| 2,728,607 | 12/1955 | Smart | 239/223 |
| 3,698,635 | 10/1972 | Sickles | 239/706 |
| 3,735,924 | 5/1973 | Wirth | 239/224 |
| 3,843,054 | 10/1974 | Kendall et al. | 239/3 |
| 3,942,721 | 3/1976 | Wirth et al. | 239/688 |
| 4,148,932 | 4/1979 | Tada et al. | 239/3 |
| 4,360,155 | 11/1982 | Hubbell et al. | 239/700 |
| 4,555,058 | 11/1985 | Weinstein et al. | 239/703 |

FOREIGN PATENT DOCUMENTS

| | | | |
|---|---|---|---|
| 112155 | 9/1964 | Czechoslovakia | 239/224 |
| 57-7783 | of 0000 | Japan . | |
| 52-25838 | 8/1975 | Japan . | |
| 52-21040 | 8/1975 | Japan . | |
| 56-29588 | 7/1981 | Japan . | |
| 56-35903 | 8/1981 | Japan . | |
| 56-35900 | 8/1981 | Japan . | |
| 869826 | 10/1981 | U.S.S.R. | 239/224 |
| 1681972 | 10/1991 | U.S.S.R. | 239/224 |

*Primary Examiner*—Andres Kashnikow
*Assistant Examiner*—Christopher G. Trainor
*Attorney, Agent, or Firm*—Schwartz & Weinrieb

[57] ABSTRACT

An outer tube 5 is integrally rotated with a rotating disk 17. A powder supply passage 16 for supply of powder particles is formed between an inner tube 15 and the outer tube 5. A lower end of the inner tube 15 is secured to a sub-disk 23, and a distributing passage 25 is formed as a space between the sub-disk 23 and the rotating disk 17. Air including powder particles introduced into a separation passage 41 is separated into air and powder in the separation passage 41, and the particles are fed to the distributing passage 25 through the powder supply passage 16. The powder particles falling in the powder supply passage 16 undergo a swirling motion in accordance with the rotation of the outer tube 5, and owing to the swirling motion, the powder particles in the powder supply passage 16 are distributed uniformly in the circumferential direction.

15 Claims, 5 Drawing Sheets

DISK-TYPE ELECTROSTATIC POWDER COATING METHOD AND AN APPARATUS THEREFOR

FIELD OF THE INVENTION

The present invention generally relates to electrostatic coating with powder particles, and more particularly, to a disktype powder coating method and an apparatus therefor in which the powder particles distributed outwardly from a disk in a circumferential or centrifugal distribution pattern form a coating upon articles to be coated.

BACKGROUND OF THE INVENTION

As an apparatus having a coating capacity several times the capacity of an ordinary coating machine, there is known a disktype electrostatic powder coating apparatus which distributes radially and outwardly from a disk particles for coating articles to be coated which move around the disk.

From the stand point of how to distribute the powder particles, such disk-type powder coating apparatus are generally classified into non-rotating disk-type apparatus in which a disk is not rotated as disclosed in U.S. Pat. No. 3,843,054 and Japanese Patent Publication No. 56-35900, and rotating disk-type apparatus in which a disk is rotated as disclosed in U.S. Pat. No. 3,735,924 and No. 3,942,721. In the non-rotating disk-type apparatus, the powder particles are distributed by means of jet streams of assist air. In the rotating disk-type apparatus, the powder is distributed by centrifugal force caused by rotation of the disk.

More specifically, in the non-rotating disk-type apparatus disclosed in Japanese Patent Publication No. 56-35900, for example, a tube extending vertically toward a central portion of a disk has air ejecting apertures for orienting the powder particles, such that the particles supplied from the tube to the disk are distributed radially outwardly from the disk by means of the assist air ejected through the apertures.

In the rotating disk-type apparatus disclosed in U.S. Pat. No. 3,735,924, a powder supplying tube is arranged to open above a central portion of a rotating disk, and the powder particles supplied from the tube to the central portion of the disk are distributed radially a outwardly from the disk by a centrifugal force caused by rotation of the disk. The disk-type electrostatic powder coating apparatus, either of the rotating type or of the non-rotating type, is constituted such that a single coating apparatus applies the powder particles onto a plurality of articles around the disk. Therefore, it is important to uniformly distribute the powder particles radially outwardly from the disk in the circumferential direction of the disk.

OBJECTS OF THE INVENTION

It is therefore a primary object of the present invention to provide a disk-type electrostatic powder coating method and an apparatus therefor that provide a uniform distribution of powder particles for supply to a disk to ensure a circumferentially uniform distribution of the particles distributed from the disk to articles to be coated.

Another object of the present invention is to provide a rotating disk-type electrostatic powder coating apparatus that provides a uniform distribution of powder particles to be supplied to a rotating disk to ensure a circumferentially uniform distribution of the powder particles distributed from the disk to articles to be coated.

SUMMARY OF THE INVENTION

In order to achieve the objects of the present invention, the present invention is basically constituted as a disk-type electrostatic powder coating apparatus which includes a disk provided with an annular electrode disposed along an outer circumferential margin thereof, a passage adjacent to a major surface of the disk for distributing powder particles supplied to a central portion of the disk in a radially outward direction to make the powder particles form a coating on articles around the disk, and further comprising:

a hollow tube vertically extending toward the central portion of the disk to define a powder supply passage which guides the powder particles toward the central portion of the disk; and driving means for rotating the tube about its axis, wherein rotation of the tube causes swirling motions in the powder particles falling through the tube toward the central of the disk, and thereby provides a circumferentially uniform supply of the powder into the distributing passage.

The present invention may be most suitable for a rotating disk-type electrostatic powder coating apparatus which includes a rotating disk provided with an annular electrode disposed along an outer circumferential margin thereof, a passage adjacent to a major surface of the rotating disk for distributing powder particles supplied to a central portion of the disk in a radially outward direction to provide powder particles for coating articles disposed around the disk, on a further comprising:

a sub-disk located below said rotating disk in a parallel relationship for defining said distributing passage therebetween;

a hollow outer tube having a lower end attached to the central portion of the rotating disk, said outer tube extending upwardly from said rotating disk, and said lower end thereof faces and opens toward said distributing passage; and a non-rotating inner tube co-axially received in said outer tube in spaced-apart relationship, said inner tube extending through said outer tube and having a lower end fixed to the central portion of said sub-disk;

wherein the space between said outer and inner tubes defines a passage for supplying the powder particles to said distributing passage.

According to such a rotating disk type coating apparatus, passage the powder particles passing through the powder supply formed between the outer tube and the inner tube is fed to the central portion of the rotating disk while making swirl-motions in accordance with rotation of the outer tube, and owing to the swirl-motions, it becomes possible to uniformly supply the powder particles to the disk in the circumferential direction.

BRIEF DESCRIPTION OF THE DRAWINGS

The above and other objects and features of the present invention will become apparent from the following description made with reference to the accompanying drawings in which like reference characters designate like or corresponding parts throughout the several views, and wherein.

DETAILED DESCRIPTION OF PREFERRED EMBODIMENTS

Figure 1:
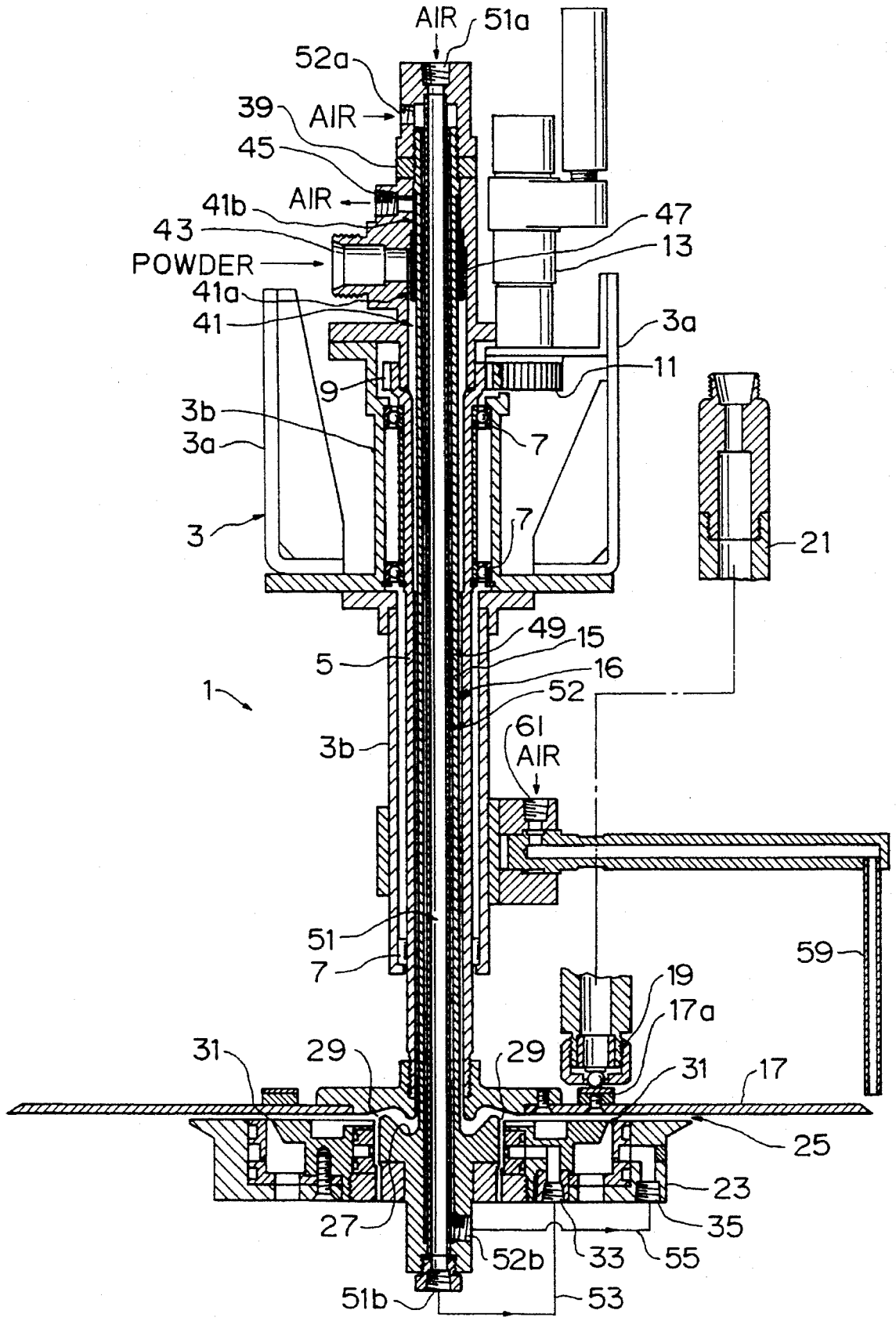
FIG. 1 is a vertical cross-sectional view of a rotating disk-type electrostatic powder coating apparatus taken as a first embodiment.
Figure 2:
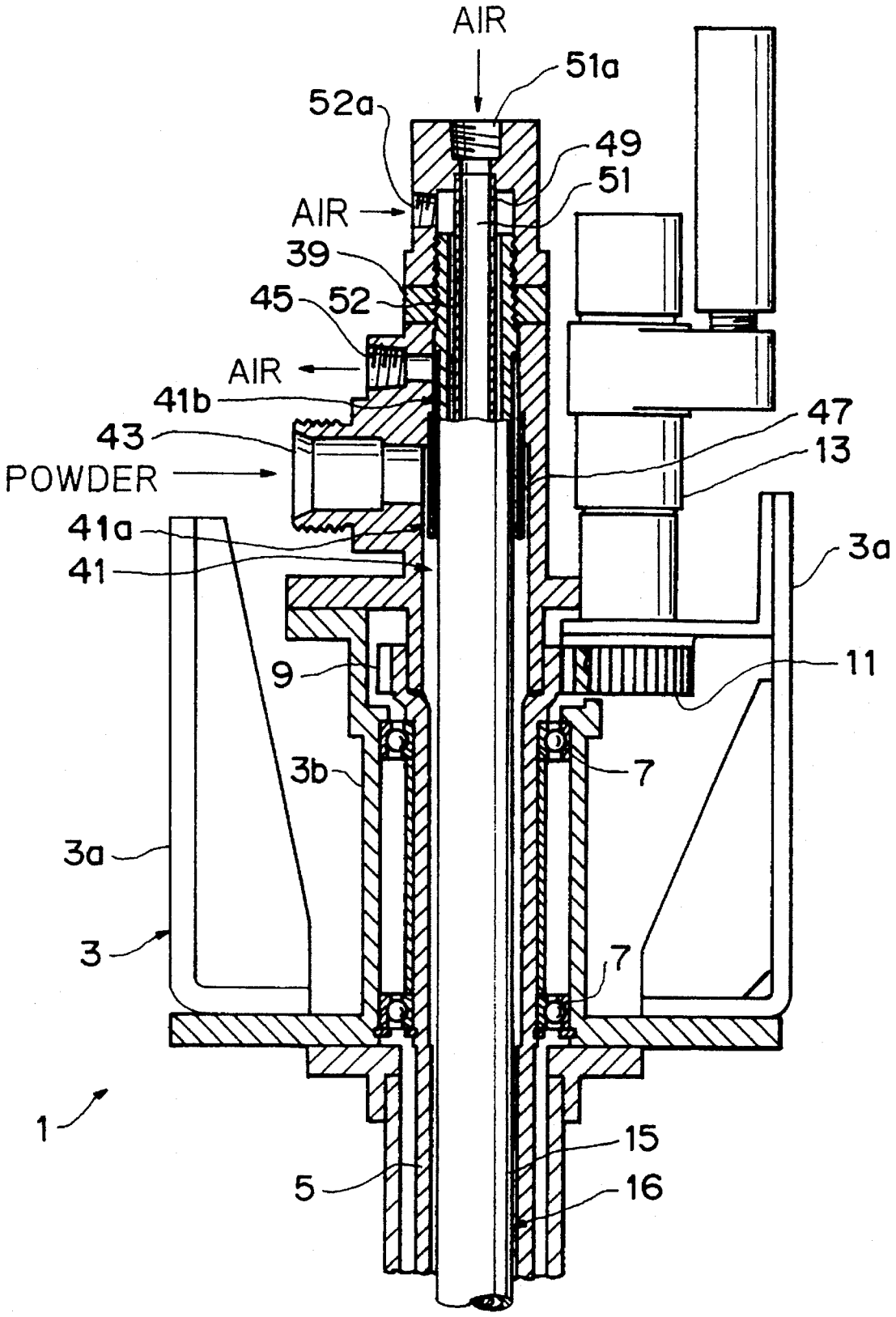
FIG. 2 is an enlarged partial vertical cross-sectional view of an upper portion of the apparatus illustrated in FIG. 1.

The first embodiment according to the present invention is illustrated in FIGS. 1 and 2. In these drawings, reference numeral 1 generally designates an electrostatic powder coating apparatus of the rotating disk-type. The apparatus 1 includes a frame 3 having an attachment face 3*a*. The attachment face 3*a* is utilized to secure the apparatus 1 to a reciprocator (not shown). As well known, the apparatus 1 serves to apply coating powder particles to articles disposed around the apparatus 1, while it is being vertically reciprocated by the reciprocator.

The frame 3 includes a cylindrical casing 3*b* integrally formed therewith. An outer tube 5, as the first tube, is inserted into the casing 3*b*, and bearings 7 are interposed between the tube 5 and the casing 3*b* such that the outer tube 5 is rotatable around its axis. A first gear 9 is secured to the outer tube 5 at an upper end thereof. A second gear 11, which engages the first gear 9, is attached to an output shaft (not shown) of an air motor 13 secured to the frame 3. When the air motor 13 is operated, the driving force thereof is transmitted to the outer cylinder or tube 5 by means of the second gear 11 and the first gear 9, whereby the outer tube 5 will be rotated around its axis.

An inner tube 15, as the second tube, is inserted co-axially in the outer tube 5. The outer face of the inner tube 15 is spaced apart from the inner face of the outer tube 5, whereby the space between the inner tube 15 and the outer tube 5 defines a powder supply passage 16 explained later in detail.

A main disk 17 is integrally attached to the lower end of the outer tube 5 so as to rotate together with the outer tube 5. The disk 17 is made of an insulating resin material and has an annular electrode extending (not shown) circumferentially about the peripheral edge of its lower face. The annular electrode is formed by applying a conductive material on the lower face of the disk 17. A contact 17*a* extending in a rotational direction is provided at a central portion on an upper face of the disk 17. The contact 17a and the annular electrode are connected by a conductive material (not shown) applied on the lower face of the disk 17. A terminal 19 is positioned over the contact 17*a* and electrically contacts the contact 17*a*. The contact 17*a* is connected, as well known, to a high voltage DC power source (not shown) by means of the terminal 19 and an insulated high-voltage cable 21. Electric power is supplied from the DC power source to the above-mentioned electrode edge through the terminal 19 and the contact 17*a*.

The inner tube 15 extends upwardly beyond an upper end of the outer tube 5 and downwardly beyond the lower end of the outer tube 5. The lower end portion of the inner tube 15 is integrally attached to the central portion of a sub-disk 23 located below the main disk 17. The sub-disk 23 is spaced apart from the lower face of the main disk 17 so that the space between the main disk 17 and the sub-disk 23 forms a powder distributing passage 25 in which powder particles travel radially outwardly. The passage 25 has a radially inner end communicating with the powder supply passage 16 and serving as an inlet for introducing the powder particles, and has a radially outer end serving as an exhaust aperture for discharging the powder particles outwardly.

The upper face of the sub-disk 23 is formed with an upward-opening annular recess 27 along its central portion opposed to the inlet of the distributing passage 25. The sub-disk 23 also has a first aperture 29 in a portion adjacent to the outer wall of the concavity 27 and a second aperture 31 in a radially intermediate portion thereof. Both of the apertures 29, 31 open at the upper face of the sub-disk 23 and are adapted to blow assist air toward the passage 25. Further provided in the lower face of the sub-disk 23 are a first air port 33 communicating with the first aperture 29 and a second air port 35 communicating with the second aperture 31 so as to introduce compressed air through these ports 33, 35 as will be later.

An extension tube 39 is air-tightly coupled to the upper end of the outer tube so as to extend the tube 5 upwardly. The extension tube 39 is integrally fixed to the casing 36 integrally. The upper end of the inner tube 15 is threaded to the upper end portion of the extension tube 39. Below the portion where the inner tube 15 is threadedly connected to the extension tube 39, the lower portion of the inner tube 15 and the extension tube 39 define an air separation passage 41 therebetween, and the passage 41 communicates with the powder supply passage 16. The extension tube 39 has first and second ports 43 and 45 which communicate with the passage 41. The first port 43 is located at an axially intermediate portion of the extension tube 39, and opens toward the tangential direction of the air separation passage 41. The first port 43 is oriented to the tangential direction with respect to the inner face of the extension tube 39. The second port 45 is located above the first port 43, and opens to the upper end portion of the air separation passage 41.

The air separation passage 41 has an upper portion which is divided into an outer passage 41*a* and an inner passage 41*b* by means of an air separating sleeve 47. The outer passage 41*a* communicates with the first port 43 which is coupled to an external piping (not shown). Air including powder particles is introduced to the air separating passage 41 through the external piping and the first port 43. The inner passage 41*b* communicates with the second port 45 which is connected to an evacuation pump (not shown) by means of an external piping (not shown) such that air in the passage 41*b* is exhausted through the second port 45.

A third tube 49 is inserted in the extension tube 39 and the inner tube 15 and extends therethrough so as to form two air passages 51, 52 on opposite sides thereof (FIG. 2). The first air passage 51, which is defined by the inside of the tube 49, has upper and lower ends. The upper end of the first passage 51 communicates with an inlet port 51*a*, and the lower end thereof communicates with an outlet port 51*b*. The inlet port 51*a* is connected to a compressed air source (not shown) by means of an external piping (not shown), and the outlet port 51*b* is connected through an external piping 53 to the air port 33 opening to the lower face of the sub-disk 23. On the other hand, the second air passage 52, which is defined around the third tube 49, has upper and lower ends. The upper end of the second passage 52 communicates with an inlet port 52*a*, and the lower end thereof communicates with an outlet port 52*b*. The inlet port 52*a* is connected to the compressed air supply source by means of an external piping (not shown), and the outlet port 52*b* is connected through an external piping 55 to the air port 35 opening at the lower face of the sub-disk 23.

Referring again to FIG. 1, a reference numeral 59 designates an air jetting tube attached to the casing 3b. The air jetting tube 59 has an opening at the downstream end thereof. The downstream opening of the tube 59 is oriented toward the annular electrode of the disk 17. Compressed air is introduced into the tube 59 through an external piping (not shown) connected to a port 61, and is jetted from the tube 59 toward the annular electrode.

In the thus constituted electrostatic coating apparatus, the powder particles, which have been introduced by air from the first port 43 into the air separation passage 41, fall with swirling motion in the passage 41 so as to be fed to the powder supply passage 16. Air in the air separation passage 41 is forced to be exhausted from the second port 45 through the inner passage 41*b*, whereby the powder particles in the air separation passage 41 which have a greater density, migrate to the powder supply passage 16. Since the outer tube 5 which constitutes the outer wall defining the outer passage 16 is rotated, the powder particles falling in the passage 16 are forced to be swirled by the rotation of the tube 5. In other words, the powder particles passing through the passage 16 fall while they are being swirled by the rotation of the outer tube 5, and thus enter the powder distributing passage 25 so as to be received by the recess portion 27. Therefore, since the powder particles enter the recess 27 with swirling motion, the powder particles are uniformly fed to the recess portion 27 in the circumferential direction and temporarily stored in the recess portion 27. Thereafter the powder particles in the recess 27 are distributed uniformly in the rotational direction by means of a centrifugal force caused by rotation of the disk 17.

As is apparent from FIG. 1, there is no member which protrudes toward the powder distributing passage 25 defined by the main disk 17 and the sub-disk 23. More specifically, the powder distributing passage 25 is formed as a passage which is completely open in its radial and circumferential directions, and there is no member which prevents the movement of the powder from passing through the passage 25. Owing to such a structure of the passage 25, it is possible to further ensure the uniform distribution of the powder particles in the circumferential direction.

The powder supply passage 16 has a passage-width or a space between the inner cylinder 15 and the outer cylinder 5 of about 3 mm. However, the width of the passage 16 is not limited to this numerical value but may be larger than 3 mm. The main disk 17 has a rotational speed of about 300 rpm. Similarly, in one embodiment, the diameter of the main disk 17 is 500 mm but is not limited to this numerical value.

In addition to the powder distribution process by means of the centrifugal force, assist air which is discharged from the first and the second apertures 29 and 31 enhances the flow rate of the powder particles traveling in the passage 25 on the basis of the Coanda effect. Thereafter, the powder particles passed over the annular electrode of the disk 17 are electrically charged by the annular electrode and are then distributed toward a plurality of articles to be coated (not shown) moving around the disk 17 so as to be coated upon the articles.

Owing to the air jetted to the annular electrode from the tube 59, it is possible to prevent the powder particles from forming clusters on the annular electrode, and hence it becomes possible to prevent the generation of a nonuniform distribution pattern of the powder particles caused by forming and peeling off of the powder clusters.

Part of the external pipes or conduits for introducing the compressed air to the first and the second apertures 29 and 31 is constituted by the air passages 51 and 52 which are formed within the inner tube 15, so that it becomes possible to simplify the external pipes or conduits for the apertures 29 and 31. The tube 49, which is inserted into the inner tube 15, forms the two air passages 51 and 52, and each one of the air passages 51, 52 forms an independent air supply passage for one of the apertures 29, 31, so that it becomes possible to individually adjust the amount of air discharged from each of the apertures 29, 31.

Figure 3:
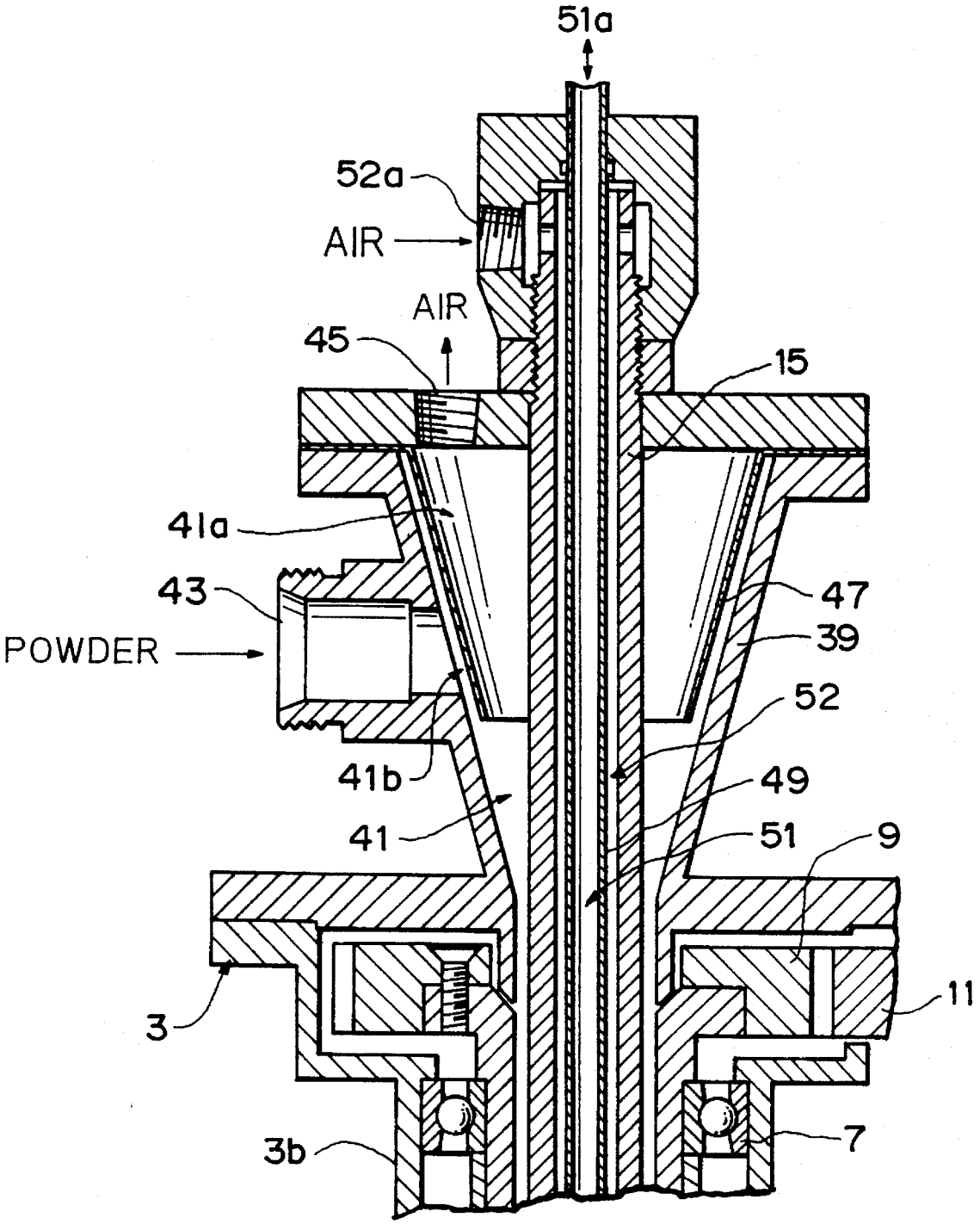
FIG. 3 is an enlarged partial vertical cross-sectional view of an upper portion of a rotating disk-type electrostatic powder coating apparatus taken as a second embodiment.
Figure 4:
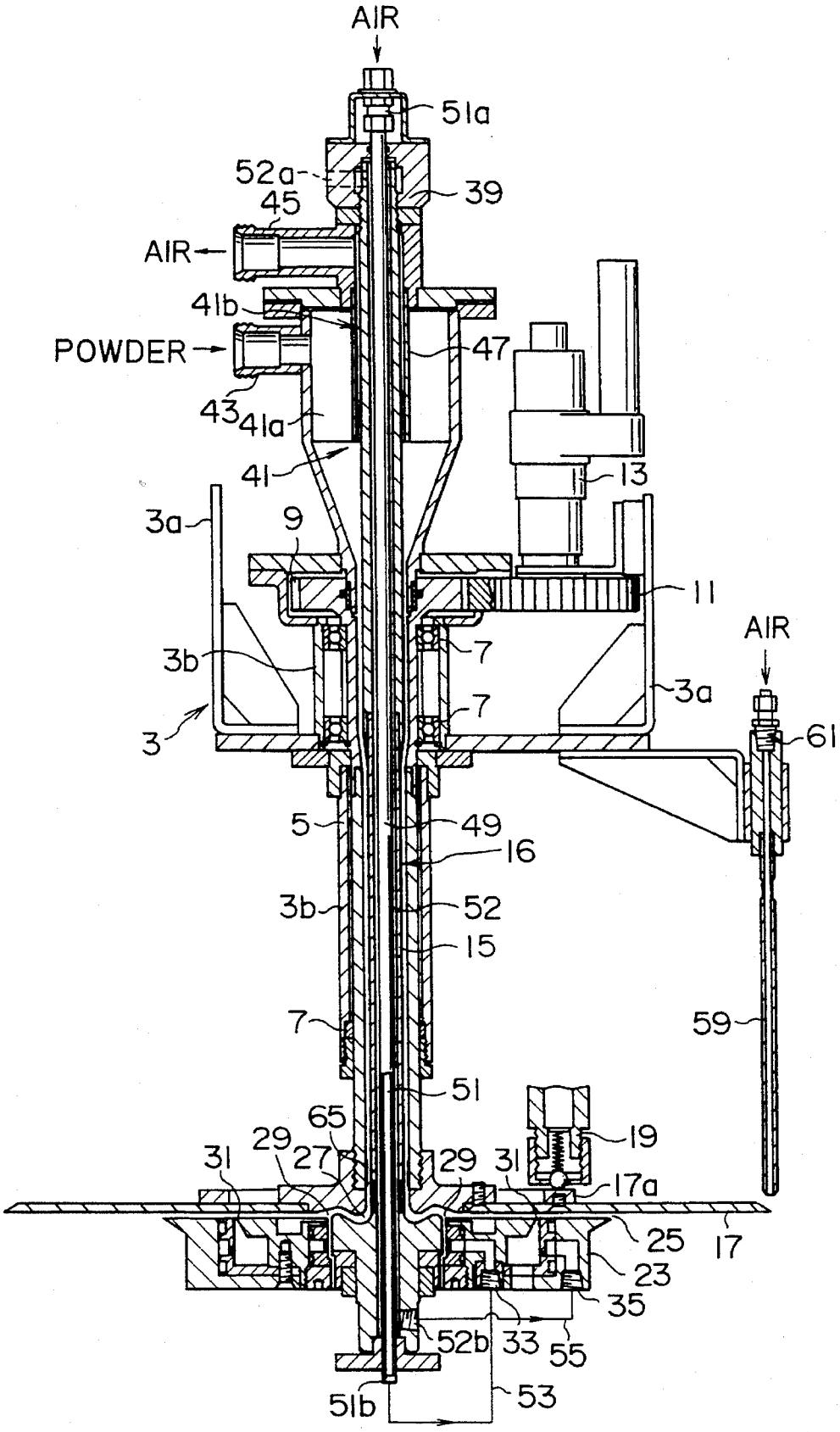
FIG. 4 is a vertical cross-sectional view of a rotating disk-type electrostatic powder coating apparatus taken as a third embodiment.
Figure 5:
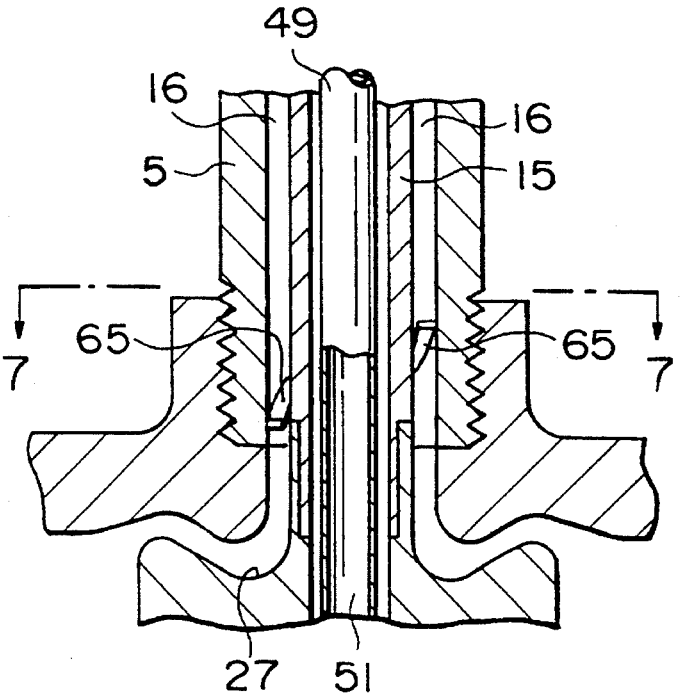
FIG. 5 is an enlarged partial vertical cross-sectional view of a lower portion of the apparatus illustrated in FIG. 4.

FIG. 3 and the following drawings show other embodiments according to the present invention, and in connection with an explanation for these embodiments, the same elements as those of the above-mentioned first embodiment are designated by the same reference numerals, whereby a detailed explanation thereof is omitted, and an explanation will be made hereinafter only for characteristic portions of each of the embodiments.

FIG. 3 shows the second embodiment in which the apparatus 1 is of the rotating disk-type as was the case of the first embodiment. Notice that the extension tube 39 has such a shape that its diameter is gradually enlarged in the upward direction. The first port 43, which is a port for supplying powder-mixed air to the passage 41, is oriented toward the tangential direction with respect to the inner face of the extension tube 39 in the same manner as that of the first embodiment. The second port 45 or the exhaust port opens upwardly. The air separating sleeve 47 also has a funnel-like shape similar to that of the extension tube 39 such that its diameter is gradually enlarged upwardly according to the shape of the extension tube 39.

FIGS. 4 to 7 show the third embodiment in which the apparatus 1 is of the rotating disk-type similar to those of the preceding embodiments. As can be recognized from the drawings, the extension tube 39 is constituted by a tube having a large diameter, and the air separating sleeve 47 is constituted by a sleeve having a diameter which is slightly larger than that of the inner tube 15 such that the space between the separating sleeve 47 and the extension tube 39 is larger than that in the preceding embodiments. The first port 43 is oriented to the tangential direction with re spect to the outer face of the sleeve 47.

Figure 6:
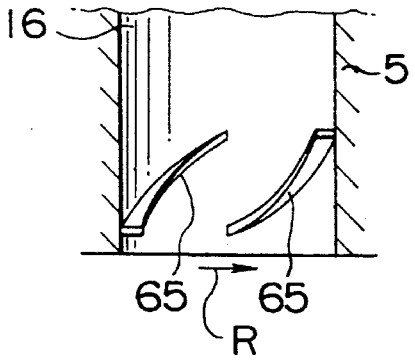
FIG. 6 is a vertical cross-sectional view of fragments of vane plates appearing in FIG. 5.
Figure 7:
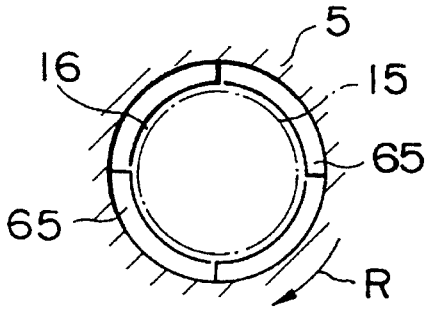
FIG. 7 is a cross-sectional view taken along the line 7—7 of FIG. 5.

In the third embodiment, four vane plates 65 are provided upon the outer tube 5 at lower end portions thereof. The vane plates 65, which project into the powder supply passage 16, are arranged at circumferentially equal intervals and secured to the inner face of the tube 5. Each of the vane plates 65 extends upwardly and downwardly and has an upper end which is located at the advanced position of the rotating direction R of the outer tube 5 and a lower send which is located at the retarded position of the direction R, and is arranged with an inclination of about 45 degrees with respect to the axis of the tube 5 (FIG. 6). Each vane plate 65 also has an inner end face which is adjacent to the outer face of the inner tube 15 (FIG. 7).

According to the third embodiment, even if a portion of the powder particles falls downwardly without swirling in the passage 16, the powder particles falling vertically in the passage 16 collide with the vane plates 65, and the direction of the movement thereof is converted into a direction opposite to the rotating direction R. Also, if the powder particles fall downwardly without swirling in the passage 16, a nonuniform distribution of the particles may be produced in the rotational direction. However, as described above, owing to the vane plates 65, the direction of the movement of the powder particles having vertically fallen is converted into the direction opposite to the rotating direction R so that the powder particles at the lower end of the passage 16 are uniformly diffused, in the circumfential direction whereby the circumferential distribution of the powder particles can be rendered uniform at the lower end of the passage 16. In addition, since the inner end faces of the vane plates 65 are adjacent to the outer face of the inner tube 15, radial deflection of the outer tube 5 and/or the inner tube 15, which may be caused by the rotation of the outer tube 5, can be prevented by the vane plates 65.

More specifically, although the outer tube 5 is supported by the casing **3*b* through means of the bearings 7, there is a risk of radial deflection occurring in the outer tube 5 as a result of the rotation of the outer tube 5 and the disk 17. When the radial deflection occurs, the width of the powder supply passage 16, which is formed between the outer tube 5 and the inner tube 15, will become nonuniform in the circumferential direction, and this may cause the supply of the particles from the passage 16 to the disk 17 to be circumferentially nonuniform. In the present embodiment, the vane plates 65 located at a place where the amplitude of the radial deflection is the largest, serve to prevent the relative radial deflection between the outer tube 5 and the inner tube 15, so that it is possible to maintain the width of the passage 16 formed by the outer tube 5 and the inner tube 15 to be uniform. This consequently means that it is possible to ensure the uniform supply of the powder particles to the central portion of the disk 17** in the circumferential direction.

According to the third embodiment, since the space between the air separating sleeve 47 and the extension tube 39 is set to be large, it is possible to reliably produce the swirl-stream in the air separation passage 41 by means of the powder-mixed air supplied from the first port 43. Therefore, owing to the difference in the centrifugal force caused by the difference between the specific gravity of the powder particles and that of air, it is possible to promote separation of the particles from the air. That is, the powder particles which are heavier than air in specific gravity are fed to the passage 16 while being positioned radially outwardly by the relatively larger centrifugal force. On the other hand, air in the air separation passage 41 passes from the lower end opening of the separating sleeve 47 through the inside of the sleeve 47 without being influenced by the centrifugal force, and is discharged from the second port 45. Owing to the promotion of air separation as described above, it is possible to increase the density of the powder at the lower end portion of the air separation passage 41.

The present invention has thus been shown and described with reference to specific embodiments. However, it should be noted that the present invention is in no way limited to the details of the described arrangements but changes and modifications may be made without departing from the scope of the invention which is determined by means of the appended claims.

For example, in the first to the third embodiments, although the explanation is made as to the case where the present invention is applied to the rotating disk-type coating apparatus, the present invention may be applied to a non-rotating disk-type coating apparatus. For instance, a hollow tube for the powder supply may be arranged so as to face a central portion of a non-rotating disk, wherein hollow tube is rotatable about its axis. Similarly, inner and outer tubes may be arranged to face a central portion of a non-rotating disk so that with rotation of the outer tube or the inner tube, the powder particles are fed to the disk through a space between the outer and the inner tubes.

Further, in the first to the third embodiments, the air separating sleeve 47 is not necessarily essential and may be removed.

Furthermore, with respect to the relationship between the rotating direction of the outer tube 5 or the directions of the assist air discharged from the apertures 29, 31 and the direction of the first port 43 to be set, for example, when the rotating direction of the outer tube 5 is clockwise, or when the assist air is discharged from the apertures 29, 31 so as to produce clockwise swirl to the powder, it is possible to determine that the swirl direction of the powder particles formed by the first port 43 is clockwise, and it is possible to determine that the swirl direction of the powder particles formed by the first port 43 is counterclockwise. In such a manner, the swirl direction produced by the first port 43 and the swirl direction produced by the rotation of the outer tube 5 are set in opposite directions, whereby it is possible to further ensure the uniform diffusion of the powder particles from the distributing passage 25 when the powder particles are fed from the air separation passage 41 to the powder passage 16.

Moreover, the vane plates 65 may be positioned at the upper end portion or an axially intermediate portion of the outer tube 5. In this case, owing to the rotation of the vane plates 65 in accordance with the rotation of the outer tube 5, it is possible to forcibly produce the swirl motion of the powder particles, and to ensure the uniform diffusion of the powder particles passing through the passage 16. Therefore, the position and configuration of the vane plates 65 are not limited to the third embodiment but the arrangement of the vane plates 65 can be experimentally selected. For example, the plates 65 may be directed upwardly and downwardly along the axis of the outer tube 5, or may be inclined in a direction opposite to that of the third embodiment.

Further, the diameter of the sub-disk 23 may be arbitrarily selected to be equal to or smaller than that of the main disk 17.

What is claimed is:

1. An electrostatic powder coating method, comprising the steps of:

supplying powder particles to a central portion of a disk through an annular passageway defined between a pair of relatively rotating tubes and which extends toward said central portion of said disk, wherein said disk is provided with an annular electrode at an outer circumferential margin thereof;

distributing said powder particles supplied to said central portion of said disk radially outwardly along a major surface of said disk; and electrically charging said distributed powder particles by means of said annular electrode, whereby said electrically charge powder particles can be electrostatically deposited upon articles disposed around said disk.

2. The method as set forth in claim 1, further comprising the step of:

conducting air through an inner one of said pair of relatively rotating tubes and toward said major surface of said disk so as to facilitate distribution of said powder particles radially outwardly along said major surface of said disk.

3. A disk-type electrostatic powder coating apparatus, comprising:

a disk provided with an annular electrode along an outer circumferential edge portion thereof;

a passage adjacent to a major surface of said disk for distributing power particles, supplied to a central portion of said disk, in a radially outward direction so as to cause said powder particles to be coated upon articles disposed around said disk;

a hollow tube extending vertically toward said central portion of said disk;

an inner tube co-axially disposed within said hollow tube in a radially spaced-apart relationship so as to define a powder supply passage therebetween which is fluidically connected to said distributing passage adjacent to said disk so as to guide said powder toward said central portion of said disk and into said distributing passage; and driving means for rotating said hollow tube about its axis, whereby rotation of said hollow tube causes swirling motion to be imparted to said powder particles falling downwardly through said powder supply passage toward said central portion of said disk and thereby provides a circumferentially uniform supply of said powder particles into said distributing passage.

4. Apparatus as set forth in claim 3, further comprising:

means for conducting air through said inner tube and toward said major surface of said disk so as to facilitate distribution of said powder particles radially outwardly along said major surface of said disk.

5. A disk-type electrostatic powder coating apparatus, comprising:

a disk provided with an annular electrode along an outer circumferential edge portion thereof;

a passage adjacent to a major surface of said disk for distributing powder particles, supplied to a central portion of said disk, in a radially outward direction so as to cause said powder particles to be coated upon articles disposed around said disk;

a hollow outer tube extending vertically toward said central portion of said disk;

an inner tube co-axially received within said outer tube in a radially spaced-apart relationship so as to define a powder supply passage therebetween which is fluidically connected to said distributing passage; and driving means for rotating one of said outer and inner tubes about its respective axis, whereby rotation of said one of said outer and inner tubes causes swirling motion to be imparted to said powder particles falling downwardly through said powder supply passage toward said central portion of said disk so to thereby provide a circumferentially uniform supply of said powder particles into said distributing passage.

6. Apparatus as set forth in claim 5, further comprising:

means fluidically connected to said inner tube for conducting air through said inner tube and toward said major surface of said disk so as to facilitate distribution of said powder particles radially outwardly along said major surface of said disk.

7. A rotating disk-type electrostatic powder coating apparatus comprising:

a rotating disk provided with an annular electrode along an outer circumferential edge portion thereof;

a passage adjacent to a major surface of said rotating disk for distributing powder particles, supplied to a central portion of said disk, a radially outward direction so as to cause said powder particles to be coated upon articles disposed around said disk;

a sub-disk located below said rotating disk and disposed in a parallel relationship with respect to said rotating disk for defining said distributing passage therebetween;

a hollow outer tube having a lower end portion thereof attached to said central portion of said rotating disk; and a non-rotating inner tube co-axially disposed within said outer tube in a radially spaced-apart relationship, said inner tube extending downwardly through said outer tube such that a lower end portion thereof is fixed to a central portion of said sub-disk, wherein said space defined between said outer tube and said inner tube defines a passage fluidically connected to said distributing passage age for supplying said powder particles to said distributing passage.

8. The apparatus according to claim 7, further comprising:

a non-rotating extension tube having a lower end portion thereof airtightly coupled to an upper end portion of said outer tube while allowing rotation of said outer tube, said extension tube extending upwardly and surrounding said inner tube so as to form an air separation passage therebetween which fluidically communicates with said powder supply passage;

wherein said extension tube has a powder supply port, and an air exhaust port, said powder supply port fluidically communicates with said air separation passage for supplying air mixed with said powder particles to said separation passage, and said exhaust port is located at a position which is above that of said powder supply port and fluidically communicates with said air separation passage so as to exhaust air from said air separation passage.

9. The apparatus according to claim 7, wherein:

said sub-disk includes apertures formed within upper face portions thereof for discharging assist air toward said distributing passage so as to assist in the scattering of said powder particles from said disk.

10. The apparatus according to claim 9, wherein:

said non-rotating inner tube comprises a first hollow tube defining a first air passage along the inside thereof, said first air passage having an upper end portion thereof fluidically connected to an air supply source and a lower end portion thereof fluidically connected to said apertures of said sub-disk through external fluid conduits.

11. The rotating disk-type electrostatic powder coating apparatus according to claim 9, further comprising:

a second hollow tube having a diameter smaller than that of said first hollow tube and disposed within said first hollow tube so as to define said first air passage therebetween, said second hollow tube defining a second air passage therewithin;

wherein said first and second air passages communicate with said apertures of said sub-disk through separate external fluid conduits, respectively.

12. The apparatus according to claim 7, wherein:

said hollow outer tube which is rotated together with said rotating disk is provided with substantially vertically extending vane plates which protrude into said powder supply passage so as to impart circumferential distribution of said powder particles within said powder supply passage.

13. The apparatus according to claim 7, further comprising:

an air jetting tube having an opening oriented toward said annular electrode disposed upon said circumferential edge portion of said rotating disk for jetting air toward said annular electrode so as to prevent said powder particles from forming clusters upon said outer circumferential edge portion of said disk.

14. The apparatus as set forth in claim 12, wherein:

said vane plates have arcuate configurations and are inclined with respect to the longitudinal axis of said hollow outer tube at an angle of approximately 45°.

15. The apparatus as set forth in claim 12, wherein:

said vane plates are interposed between said hollow outer tube and said inner tube so as to maintain the radially spacing defined between said outer and inner tubes substantially constant so as to insure uniform circumferential distribution of said powder particles.

* * * * *